United States Patent [19]

Tsuyuki

[11] Patent Number: 4,812,061

[45] Date of Patent: Mar. 14, 1989

[54] TECHNIQUE FOR IMPROVING THE WEAR RESISTANCE OF A WIRE MATRIX PRINTING HEAD

[75] Inventor: Shinzi Tsuyuki, Shizuoka, Japan

[73] Assignee: Tokyo Electric Co., Ltd., Tokyo, Japan

[21] Appl. No.: 88,057

[22] Filed: Aug. 21, 1987

[30] Foreign Application Priority Data

Aug. 28, 1986 [JP] Japan ..... 61-202433

[51] Int. Cl.[4] ..... B41J 3/12

[52] U.S. Cl. ..... 400/124; 101/93.05; 335/270

[58] Field of Search ..... 400/124, 53; 101/93.05; 335/270, 273, 275, 279

[56] References Cited

U.S. PATENT DOCUMENTS

| | | | |
|---|---|---|---|
| 3,889,793 | 6/1975 | Cattaneo | 400/124 |
| 4,037,532 | 7/1977 | Plaza et al. | 101/93.48 |
| 4,653,943 | 3/1987 | Sakaida et al. | 400/124 |

FOREIGN PATENT DOCUMENTS

| | | | |
|---|---|---|---|
| 7108228 | 11/1973 | Fed. Rep. of Germany . | |
| 1136062 | 5/1957 | France | 335/276 |
| 58881 | 5/1981 | Japan | 400/124 |
| 150566 | 11/1981 | Japan | 400/124 |
| 47672 | 3/1982 | Japan | 400/53 |
| 57-126671 | 8/1982 | Japan | 400/124 |
| 199168 | 11/1983 | Japan | 400/124 |
| 42970 | 3/1984 | Japan | 400/124 |
| 54572 | 3/1984 | Japan | 400/124 |
| 98867 | 6/1984 | Japan | 400/124 |
| 155057 | 9/1984 | Japan | 400/124 |
| 2374 | 1/1985 | Japan | 400/124 |
| 135263 | 7/1985 | Japan | 400/53 |
| 60-124260 | 7/1985 | Japan | 400/124 |

OTHER PUBLICATIONS

Patent Abstracts of Japan, vol. 8, No. 158 (M-311)[1595], 21st Jul. 1984; & JP -A-59 52667(Nippon Denki K.K.) 27-03-1984.

*Primary Examiner*—David A. Wiecking

*Attorney, Agent, or Firm*—Frishauf, Holtz, Goodman & Woodward

[57] ABSTRACT

A printing head comprises a plurality of printing wires, a plurality of armatures connected at their tips to the base ends of the printing wires, an armature supporting member for rotatably supporting the plurality of armatures so that the tips of the armatures are movable in the longitudinal direction of the printing wires, a reciprocable drive unit for driving the plurality of armatures to reciprocate the plurality of printing wires between a projected position and a drawn position in the longitudinal direction of the plurality of printing wires, and wear resistant chips mounted on the rotatably supporting portions of the plurality of armatures on the armature supporting member.

11 Claims, 4 Drawing Sheets

TECHNIQUE FOR IMPROVING THE WEAR RESISTANCE OF A WIRE MATRIX PRINTING HEAD

BACKGROUND OF THE INVENTION

The present invention relates to a printing head using a plurality of printing wires.

A printing head comprising a plurality of printing wires, a plurality of armatures connected at their tips to the base ends of the printing wires, armature supporting means for rotatably supporting the plurality of armatures so that the tips of the armatures are movable in the longitudinal direction of the printing wires, and reciprocable drive means for driving the plurality of armatures to reciprocate the plurality of printing wires between a projected position and a drawn position in the longitudinal direction of the plurality of printing wires, has been already known by Japanese Patent Disclosure (Kokai) No. 60(1985)-124260.

In the printing head disclosed in Japanese Patent Disclosure (Kokai) No. 60(1985)-124260, the surfaces of the plurality of armatures are respectively coated with manganese phosphate films to prevent the rotatably supporting portions of the armatures from wearing on the armature supporting means. The manganese phosphate is a porous crystal which can hold lubricant, so that the lubricant is not splashed by the high speed operations of the armatures.

However, since the lubricant varies in its viscosity by temperature, the operating speeds of the armatures become irregular if the temperature of the lubricant largely alters due to the high speed operations of the armature and the temperature change in the circumferential environment of the printing head, thereby resulting in an instability in the impact forces of the printing wires and hence in a deterioration in the quality of printing.

The lubricant tends to absorb ink cake, printing sheet chips, and dust to cause the operations of the armatures to be disturbed.

Since the manganese phosphate films covered on the surfaces of the armatures are thin, the films are eventually worn to expose the surfaces of the armatures. At this time, the armatures fixed with the printing wires must be disposed, and this is uneconomical. Further, it is impossible to precisely control the thickness of the manganese phosphate film because the manganese phosphate is coated on the surfaces of the armatures by dipping the armatures in a mixture solution of primary manganese phosphate and phosphoric acid. This inhibits the armatures from being precisely controlled in size and hence prevents minimization the printing head size.

SUMMARY OF THE INVENTION

It is an object of the present invention to provide a printing head which can obviate the necessity of using lubricant which causes various drawbacks described above, can have much longer wearing time than the above-mentioned conventional one, can eliminate the necessity of disposing armatures fixed with printing wires when a predetermined value of wear is produced and thereby making the printing head more economical, and can precisely control the size of the armatures and can hence minimize the size of the printing head.

The object of the present invention is achieved by a printing head comprising a plurality of printing wires, a plurality of armatures connected at their tips to the base ends of the printing wires, armature supporting means for rotatably supporting the plurality of armatures so that the tips of the armatures are movable in the longitudinal direction of the printing wires, reciprocable drive means for driving the plurality of armatures to reciprocate the plurality of printing wires between a projected position and a drawn position in the longitudinal direction of the plurality of printing wires, and wear resistant chips mounted on the rotatably supporting portions of the plurality of armatures on the armature supporting means.

The chip-shaped, wear resistant members have a much longer wearing time than the above-mentioned conventional wear resistant film. Further, the chip-shaped, wear resistant members are mounted on the rotatably supporting portions of the armatures after being manufactured separately from the armatures. Thus, even when the wear resistant chip is worn to a predetermined value, it is possible to separate and dispose of only the worn chip from the armature and can be disposed. When a new wear resistant chip is thereafter mounted on the rotatably supporting portion of the armature, the armature can be economically reused. The wear resistant chip separately manufactured from the armatures can be precisely controlled in size at manufacturing time. Therefore, the armature can be controlled precisely in size and the size of the printing head can be reduced.

In the printing head according to the present invention, which is characterized by being constructed as described above, it is preferable that the wear resistant chip is formed of a synthetic resin having self-lubricating properties.

The synthetic resin can be readily precisely worked, and is inexpensive. The self-lubricating properties of the synthetic resin can further reduce the wear of the wear resistant chip and the member of the armature supporting means contacting the chip. Since the synthetic resin does not absorb ink cakes, print sheet chips, and dust, the operations of the armatures are not disturbed thereby.

It is preferable that the wear resistant chips are detachably mounted on the rotatably supporting portion of the plurality of armatures. This further facilitates the mounting and dismounting of the wear resistant chip on and from the rotatably supporting portion of the armature. This enables precise control of the size as compared with the case that the chip is attached with an adhesion or by insert molding or outsert molding on the supporting portion of the armature, and does not need an independent unit for these attaching work. Because the adhesion makes precise control of the thickness difficult and a thermal shrinkage caused in the insert or outsert molding also makes a precise control of the size.

In the case that the wear resistant chips are detachably mounted on the rotatably supporting portions of the plurality of armatures, it is preferable that the rotatable supporting portions of the armatures are of flat shape, and the wear resistant chip has a substrate to be superposed on one flat-surface area of the rotatably supporting portion of the armature and a plurality of legs projected from the substrate to contact a plurality of side-surface areas crossing the flat-surface area of the rotatable supporting portion of the armature. This facilitates the mounting and the dismounting of the wear resistant chip on and from the supporting portion of the armature.

In the printing head according to the present invention constructed as described above, it is preferable that the armature supporting means includes an armature supporting member having a plurality of guide grooves into which the respective parts of the armatures are inserted to be guided in the rotation of the plurality of armatures, and a removal preventing member contacting the armatures to prevent the plurality of armatures from being removed from the plurality of guide grooves of the armature supporting member. This arrangement makes the structure of the armature supporting means be simple and compact, thereby the printing head becomes compact.

Further, in the printing head according to the present invention which is constructed as described above, it is preferable that the plurality of armatures are formed of magnetic materials and have flat shapes at least in the rotatably supporting portions thereof, the reciprocable drive means has an electromagnet for driving the printing wires from the drawn positions to the projected positions, and the electromagnet has a magnetic plate connected to the yoke of the electromagnet, and having a plurality of recesses into which at least the flat shaped rotatably supporting portions of the armatures are inserted, the recesses having inner peripheral surfaces which face at least the longitudinally extended side-surface areas of the flat shaped rotatably supporting portions of the armatures.

This arrangement enhances the operating efficiency of the reciprocally drive means when the reciprocally drive means includes the electromagnet. Because the lines of magnetic force generated from the electromagnet are transmitted through the plurality of recesses of the magnetic plate connected with the yoke and at least the longitudinally extended side-surface areas of the flat shaped rotatably supporting portion of the plurality of armatures, the longitudinally extended side-surface areas opposing to the recesses of the magnetic plate. As a result, the reciprocally drive means becomes compact, the size of the printing head is reduced.

In this arrangement, when the wear resistant chips are detachably mounted on the rotatably supporting portions of the plurality of armatures, the rotatably supporting portions of the armatures are of flat shape, and the wear resistant chip has a substrate to be superposed on one flat-surface area of the rotatably supporting portion of the armature and a plurality of legs projected from the substrate to contact a plurality of side-surface areas crossing the flat-surface area of the rotatably supporting portion of the armature, it is particularly preferable that the plurality of legs of the wear resistant chip cover one portion of the longitudinally extended side-surface areas of the rotatably supporting portion of the armature.

This arrangement enhances the operating efficiency of the reciprocable drive means when the reciprocable drive means has the electromagnet. Because the degree in the intensity of the lines of magnetic force, generated from the electromagnet and transmitted to the plurality of armatures through the plurality of recesses of the magnetic plate connected to the yoke of the electromagnet and at least the longitudinally extended side-surface areas of the rotatably supporting portion of the plurality of armatures opposed to the recesses, is not significantly reduced by the wear resistant chip. As a result, the reciprocable drive means becomes more compact, the size of the printing head hence becomes more compact.

Also, the legs of the wear resistant chip prevent the longitudinally extended side-surface areas of the rotatably supporting portion of the armature from being worn by the inner peripheral surface of the corresponding one of the recesses of the magnetic plate, and substantially reduces the friction between the armature and the inner peripheral surface of the corresponding recess. These further reduce the size of the components for interrupting the motion of the armatures, so that the reciprocable drive means becomes compact, and the printing head hence becomes compact.

In case the reciprocable drive means has the electromagnet as described above, it is preferable that the reciprocable drive means includes urging means for urging the printing wires toward the drawn position, and a stop member for holding against the urging force of the urging means the armatures at a predetermined position to locate the printing wires at the drawn position. The reciprocable drive means constructed by the combination described above is simple in its construction and compact.

DETAILED DESCRIPTION OF THE PREFERRED EMBODIMENTS

Figure 1:
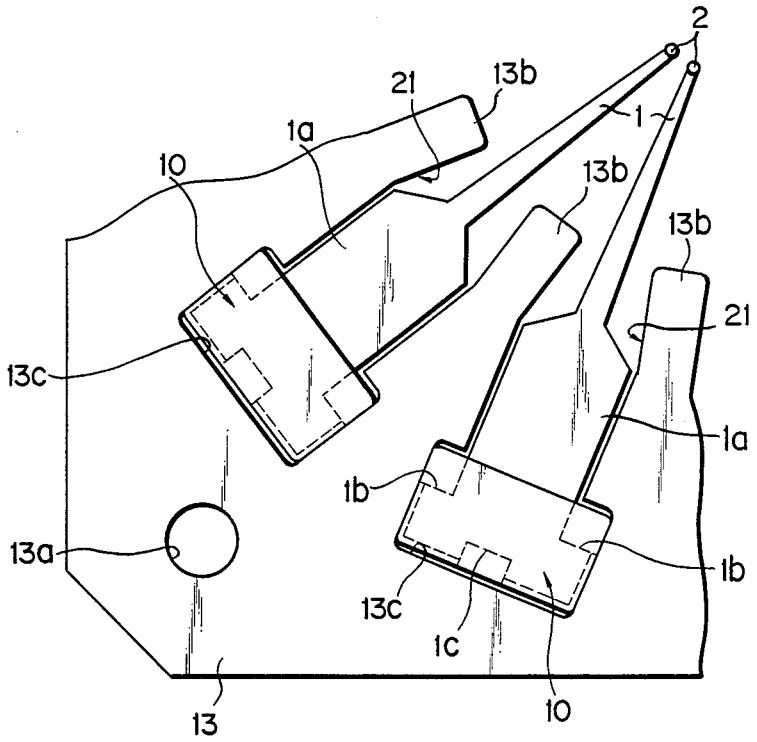
FIG. 1 is an enlarged plan view schematically showing only the circumference of an armature of a printing head of an embodiment according to the present invention.
Figure 2:
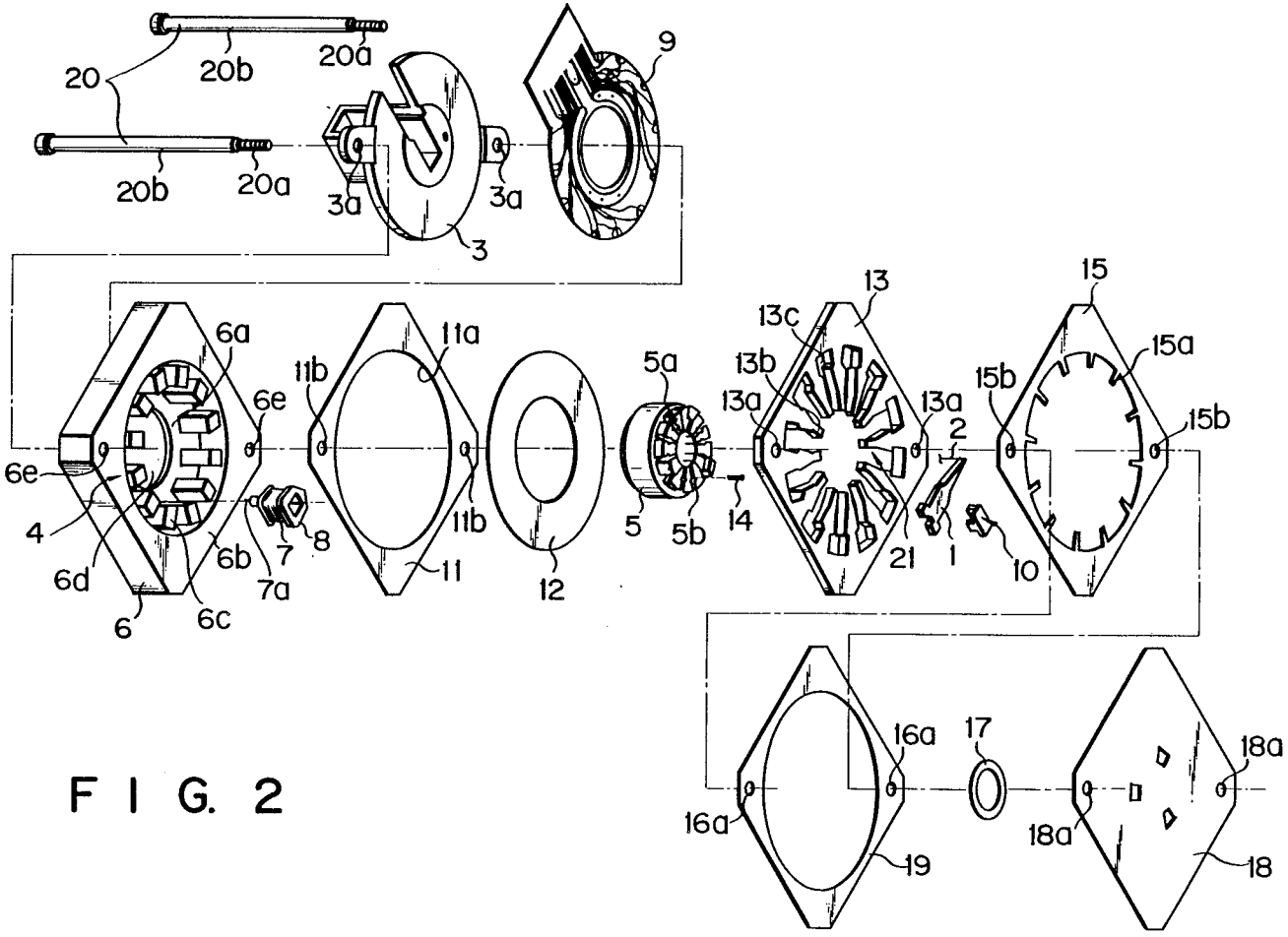
FIG. 2 is an exploded schematically perspective view of the printing head of the embodiment.
Figure 3:
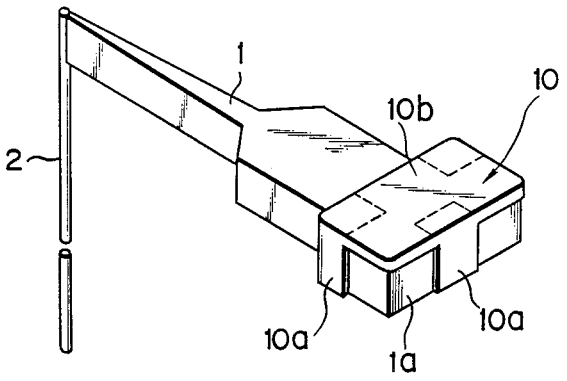
FIG. 3 is a schematic perspective view of the armature of the printing head of the embodiment.
Figure 4:
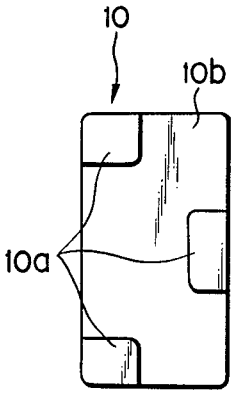
FIG. 4 is a bottom view of a wear resistant chip detachably mounted on a rotatably supporting portion of the armature of FIG. 3.
Figure 5:
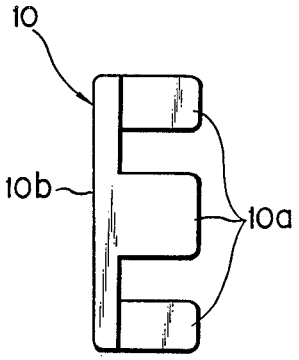
FIG. 5 is a back view of the wear resistant chip of FIG. 4.

Referring to FIGS. 1 and 2, printing wire 2 is perpendicularly fixed at its base end to the tip of oar-like metal armature 1, which is converged toward its tip, by fixing means such as brazing. Armatures 1 as described above, the number of which corresponds to that of printing dots such as twelve, are provided. Armature 1 with printing wire 2 is associated with wire guiding member 3 ordinarily called "nose", electromagnetic driving means 4 and armature supporting member 5. Wire guiding member 3 guides the movements of printing wire 2 in a direction (longitudinal direction of printing wire 2, or lateral direction of FIG. 2) perpendicular to a print sheet (not shown) disposed to oppose to the left end of wire guiding member 3 in FIG. 2. Electromagnetic driving means 4 is arranged with yoke 6 as a base. Yoke 6 is formed in a substantially square shape. A space 6*a* of a circular recess is formed in a surface of yoke 6. Protruding cores 6*c* of the same number (i.e., 12) as that of armatures 1 are formed in a circle at an equal interval in a protruded state on the bottom surface of space 6*a* of yoke 6. A coil bobbin 8 on which coils 7 are wound is fitted over at its central opening each of cores 6*c*, so that an electromagnet is thus constructed. Opening 6*d* is formed at the center of the bottom surface of space 6*a* of yoke 6. Annular printed substrate 9 is mounted on the left side surface of yoke 6 so that substrate 9 locates concentrically with through hole 6d of yoke 6. Coil terminal 7a of coil 7 is electrically connected to wirings on substrate 9, and a driving power source, not shown, is also electrically connected to the wirings. In other words, the power source, not shown, and coil 7 are electrically connected with each other through substrate 9. Substrate 9 is fixed to the left side surface of yoke 6 after the electric connection of coil terminal 7a is made. . Thin magnetic plate 11 having opening 11a of substantially the same diameter as that of space 6a and magnetic plate 13 having substantially the same thickness as that of armature 1 are assembled on right side surface 6b of yoke 6. A circular opening is formed at the center of plate 13 to be concentric with through opening 6d of yoke 6. Recesses 21 the shape of each of which is the same as that of armature 1 are formed radially on the peripheral surface of the circular opening of plate 13. The number of recesses 21 is the same (i.e., 12) as that of armatures 1. An annular magnetism preventing film 12 extends into opening 11a of thin magnetic plate 11, and film 12 is interposed between a plurality of electromagnets in space 6a of yoke 6 and a plurality of recesses 21 of plate 13. Thin magnetic plate 11 is disposed between right side surface 6d of yoke 6 and magnetic plate 13 to efficiently lead a magnetic flux from yoke 6 to plate 11.

Armature supporting member 5 is contained in space 6a of yoke 6, and is fitted in through opening 6d of yoke 6. Supporting member 5 has a cylindrical shape, and a projected end surface on which a plurality of guide grooves 5a extend radially is formed on the right side surface of member 5. The right side projection of member 5 is inserted into the central openings of film 12 and plate 13. Converged end portions of armatures 1 are respectively inserted into guide grooves 5a of member 5 so that the tips of armatures 1 disposed in recesses 21 of plate 13 do not move except in the longitudinal directions of printing wires 2. Wires 2 fixed to the tips of armatures 1 are extended through the central opening of member 5 to guiding member 3. Coil spring containing holes 5b are formed half way in the radial direction of guide grooves 5a of member 5, and reset urging means 14 constructed by coil springs are respectively contained in holes 5b of member 5. Urging means 14 contact the lower surfaces (left side surfaces in FIG. 2) of the converged end portions of the armatures 1 inserted into corresponding grooves 5a of member 5 to urge the converged end portions of armatures 1 toward resetting position, or start position (rightward in FIG. 2).

Wear resistant chip 10 is fitted over the right side surface of rotatably supporting portion 1a of armature 1. Removal preventing member 15 for preventing a plurality of armatures 1 from being removed from a plurality of recesses 21 of magnetic plate 13 is mounted on the right side surface of plate 13. Member 15 is formed of a spring steel. An opening having substantially the same diameter as that of a circle passing the radially outer ends of recesses 21 of plate 13 is formed at the center of member 15 to be concentric with through opening 6d of yoke 6. A plurality of elastic projections 15a are radially formed on the inner peripheral edge of the central opening of member 15 to project over a plurality of recesses 21 of plate 13 and to press through wear resistant chips 10 supporting portions 1a of armatures 1 in a plurality of recesses 21 of plate 13. Cover plate 18 is mounted over through spacer 16 on the right side surface of member 15. Ring-like stopper 17 is fixed on the inner surface (i.e., the left side surface) of cover plate 18 to be concentric with through opening 6d of yoke 6. Stopper 17 contacts the converged end portions of armatures 1 in recesses 21 of plate 13. Thus, stopper 17 determines the resetting positions (the start positions) of the tips of armatures 1 urged by urging means 14, i.e., the drawn positions of printing wires 2. Stopper 17 is formed of a viscoelastic material to absorb an impact force generated by the collision of armature 1. When the thickness of spacer 16 is changed, the resetting positions (the start positions) of the tips o armatures 1, i.e., the drawn positions of wires 2, can be changed. 7 pairs of pin holes 3a, 6e, 11b, 13a, 15b, 16a, 18a are respectively and diagonally formed on wire guiding member 3, yoke 6, thin magnetic plate 11, magnetic plate 13, armature supporting removal preventing member 15, spacer 16 and cover plate 18. A pair of headed clamping pins 20 are respectively inserted into the paired pin holes from wire guiding member 3 toward cover plate 18, and the above-mentioned various parts and members are integrally clamped by threading of nuts (not shown) over thread portions 20a at the free end portions of pins 20 projected from the right side surface of plate 18.

The resetting position (the start position) of armature 1 at non-printing time is determined by a distance from the right side surface 6b of yoke 6 to the contacting surface of stopper 17 to which armatures 1 contact. The factors for determining the distance are the thicknesses of plate 11, plate 13, member 15, spacer 16 and stopper 17. The other four members except stopper 17 are formed of flat iron plates. Therefore, these four members are inexpensive and can be readily managed in sizes. The flatness and the parallelism of each of the four members can be readily managed. Consequently, the irregularity in the resetting positions of armatures 1 is small.

The task of inserting a spacer for regulating the armature resetting position (starting position) between cover plate 18 and stopper 17 or between armature 1 and stopper 17 can be simply carried out merely by removing plate 18. When the thicknesses of the above-mentioned four members are measured in advance before assembling and a spacer of necessary thickness as resultantly required is inserted in advance into predetermined position, the resetting position regulating work after assembling is not necessary and further simplifies the assembling work of the printing head. The thicknesses of these four members can be readily automatically measured at present now that inexpensive computers have come into wide use. When the flatnesses and the parallelisms of these four members are automatically managed from iron plates before working, the resetting position regulating work can be entirely eliminated.

The shapes and corelationship of rotatably supporting portion 1a of armature 1, wear resistant chip 10 and magnetic plate 13 as the features of this embodiment will be described with reference to FIGS. 1, 3 to 5. Chip 10 is formed, for example, of a synthetic resin having self-lubricating properties such as nylon 66. Chip 10 consists of a substrate 10b superposed on one flat surface area of rotatably supporting portion 1a of armature 1 and three legs 10a projected from substrate 10b. When substrate 10b of chip 10 is superposed on supporting portion 1a of armature 1, three legs 10a, as particularly shown, are inserted from above to the portions immediately before front edges 1b of wide portions laterally projected from the ends of both sides of supporting portion 1*a* of armature and central recess 1*c* of the end face of supporting portion 1*a* of armature 1. The outer surface of chip 10 is slightly projected from the outer surface of supporting portion 1*a* of armature 1. The size in the plan view of substrate 10*b* of chip 10 is slightly larger than that in the plan view of supporting portion 1*a* of armature 1. Projections 13*b* between a plurality of recesses 21 of magnetic plate 13 are opposed to the longitudinally extended side-surfaces of armatures 1 in recesses 21 of plate 13. The deepest portions of recesses 21 of plate 13 are formed as guides 13*c* having substantially the same plane shape and size as those of chip 10.

Legs 10*a* of chip 10 projected from supporting portion 1*a* of armature 1 contact with the inner surface of guide 13*c* of plate 13, and supporting portion 1*a* of armature 1 is not directly contacted with the inner surface of guide 13*c*. In other words, there is no wear due to slidable contact between metal magnetic plate 13 and supporting portion 1*a* of metal armature 1. Substrate 10*b* of chip 10 is also interposed between supporting portion 1*a* of armature 1 and elastic projection 15*a* of member 15. Magnetism preventing film 12 is also interposed between the bottom surface of supporting portion 1*a* of armature 1 not superposed with substrate 10*b* of chip 10 and coil bobbin 8 of the electromagnet of yoke 6. In other words, no metal-to-metal contact exists between supporting portion 1*a* of armature 1 and the adjacent member such as magnetic plate 13, removal preventing member 15, or coil bobbin 8. Therefore, it is not necessary to apply oil around supporting portion 1*a* of armature 1. As a result, it can prevent the printing head from becoming defective due to use of oil. More specifically, it does not adversely affect the operation of armatures 1 and hence the impact force of printing wires 2. The operation of wire 2 under uniform impact force allows satisfactory printing. A magnetic flux produced in the electromagnet of yoke 6 goes in and out from the longitudinally extended side surfaces of armatures 1 and the inner peripheries of recesses 21 of magnetic plate 13 opposed thereto. This ensures an increase in the magnetic flux efficiency without increasing the surrounding structure of armatures 1. In other words, the operating efficiency of the electromagnets is enhanced. As a result, electric power for the driving force of the printing head can be reduced, and the whole construction of reciprocally drive means including the electromagnets can be compacted.

The above-described embodiments are only for illustration, and do not limit the present invention. Various other changes and modifications may be made within the spirit and scope of the present invention.

For example, polyacetal and polybutylene terephthalate may be used as synthetic resin having self-lubricating properties for forming chip 10.

Wear resistant chip 10 may be formed in shapes shown in FIGS. 6 to 9.

Figure 6:
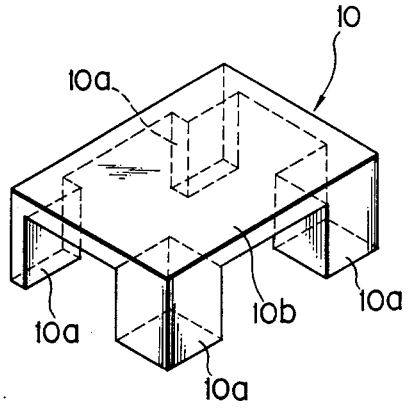
FIGS. 6 to 9 are schematic perspective views showing various modified examples of the wear resistant chip.
Figure 7:
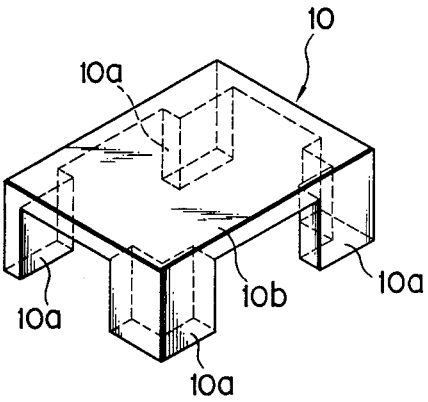

Chips 10 shown in FIGS. 6 and 7 have four legs 10*a* projected from four corners on the lower surface of substrate 10*b* of chip 10. In any of chips 10 shown in FIGS. 6 and 7, the longitudinal length of each of two legs 10*a* for engaging with the front edges 1*b* of the side projections of rotatably supporting portion 1*a* of armature 1 is shorter than that of each of the remaining two legs 10*a*. In the example of chip 10 shown in FIG. 7, the cross section of each of the remaining two legs 10*a* is substantially L shape. In chips 10 shown in FIGS. 6 and 7, the leg 10*a* having shorter longitudinal length increases an area of the corresponding longitudinally extended side surface of supporting portion 1*a* of armature 1 opposing to the inner surface of corresponding recess 21 of magnetic plate 13. Thus, the quantity of magnetic flux, fed from the inner peripheral surfaces of recesses 21 of plate 13 and going in and out from supporting portions 1*a* of armatures 1, increases to improve the magnetic flux efficiency of the electromagnets.

Figure 8:
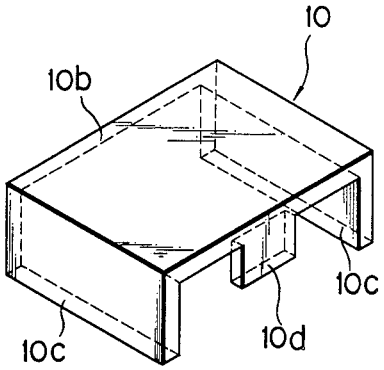

Wear resistant chip 10 shown in FIG. 8 has side walls 10*c* and tongue piece 10*d* at both side edges and rear edge of the lower surface of substrate 10*b* of chip 10 to contact the longitudinally extended side surfaces and the rear end surface of rotatably supporting portion 1*a* of armature 1.

Figure 9:
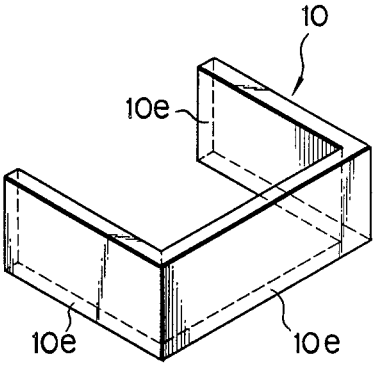

Wear resistant chip 10 shown in FIG. 9 does not have substrate 10*b* to be superposed on one flat surface of rotatably supporting portion 1*a* of armature 1, but has three side walls 10*e* integrally formed to contact the longitudinally extended side surfaces and the rear end surface of supporting portion 1*a* of armature 1. Three side walls 10*e* of chip 10 completely cover the longitudinally extended side surfaces and the rear end surface of supporting portion 1*a* of armature 1. Chip 10 shown in FIG. 9 and constructed as described above cannot be supported on the outer surface of supporting portion 1*a* of armature 1 by each elastic projection 15*a* of removal preventing member 15. Therefore, an adhesion must be used to attach chip 10 of FIG. 9 on the outer surface of supporting portion 1*a* of armature 1. To prevent the wear of the outer surface of supporting portion 1*a* of armature 1 due to the direct contact between corresponding one projection 15*a* of member 15 and the outer surface of supporting portion 1*a* of armature 1, another independent wear resistant plate is interposed between the projections 15*a* of member 15 and the outer surfaces of supporting portions 1*a* of armatures 1.

What is claimed is:

1. A printing head comprising:

a plurality of printing wires each having a base end;

a plurality of armatures equal in number to the plurality of printing wires, each of said plurality of armatures having a tip and a rotatably supported portion, the plurality of armatures having the tip of each connected, respectively, to the plurality of printing wires at the base end thereof;

armature supporting means for rotatably supporting the rotatably supported portion of each of the plurality of armatures so that the tip of each of the plurality of armatures is movable in the longitudinal direction of the printing wires;

reciprocal drive means for driving the plurality of armatures to reciprocate the plurality of printing wires between a projected position and a drawn position in the longitudinal direction of the plurality of printing wires; and a plurality of wear resistant chips detachably mounted, respectively, on the rotatably supported portion of the plurality of armatures.

2. A printing head according to claim 1, wherein each of the wear resistant chips is formed of a synthetic resin having self-lubricating properties.

3. A printing head according to claim 1, wherein the rotatably supported portion of each of the armatures comprises a flat surface, and wherein each of the wear resistant chips has a substrate superposed on said flat surface of the rotatably supported portion of each of the armatures and a plurality of legs projected from the substrate to contact a peripheral surface of the rotatably supported portion of its corresponding armature.

4. A printing head according to claim 3, wherein the plurality of legs of each of the wear resistant chips cover a pair of longitudinally extended areas of the peripheral surface of the rotatably supported portion of each of the armatures.

5. A printing head according to claim 1, wherein the armature supporting means includes an armature supporting member having a plurality of guide grooves into each of which the rotatably supported portion of each of the armatures is inserted to be rotatably guided, and a removal preventing member contacting the armatures to prevent the plurality of armatures from being removed from the plurality of guide grooves of the armature supporting member.

6. A printing head according to claim 1, wherein each of the plurality of armatures is formed of magnetic material and has a flat shape at least in the rotatably supported portion thereof, the reciprocal drive means has an electromagnet for driving the printing wires from the drawn positions to the projected positions, and the electromagnet has a magnetic plate connected to a yoke of the electromagnet, and having a plurality of recesses into which, respectively, at least the flat shaped rotatably supported portion of the plurality of armatures is inserted, each of the plurality of recesses having an inner peripheral surface which respectively faces at least a pair of longitudinally extended areas of the peripheral surface of the flat shaped rotatably supported portion of one of the plurality of armatures.

7. A printing head according to claim 6, wherein the reciprocal drive means includes urging means for urging the printing wires toward the drawn positions, and a stop member for holding the armatures at a predetermined position against the urging force of the urging means to locate the printing wires at the drawn position.

8. A printing head according to claim 6, wherein each of the wear resistant chips is formed of a synthetic resin having self-lubricating properties.

9. A printing head according to claim 6, wherein the rotatably supported portion of each of the plurality of armatures comprises a flat surface, and wherein each of the wear resistant chips has a substrate superposed on said flat surface of the rotatably supported portion of each of the plurality of armatures and a plurality of legs projected from the substrate to contact a a peripheral surface of the rotatably supported portion of its corresponding armature.

10. A printing head according to claim 9, wherein the plurality of legs of each of the wear resistant chips partially cover a pair of longitudinally extended areas of the peripheral surface of the rotatably supported portion of each of the plurality of armatures.

11. A printing head according to claim 1, wherein the rotatably supported portion of each of the plurality of armatures is of flat shape, and each of the wear resistant chips covers at least one part of the peripheral surface of the rotatably supported portion of each of the plurality of armatures.

* * * * *